US012453919B2

(12) United States Patent
Israel, Jr.

(10) Patent No.: US 12,453,919 B2
(45) Date of Patent: Oct. 28, 2025

(54) BILLIARDS TRAINING DEVICE FOR GROOVING A POOL STROKE

(71) Applicant: Edwin Julius Israel, Jr., Hillsville, VA (US)

(72) Inventor: Edwin Julius Israel, Jr., Hillsville, VA (US)

( * ) Notice: Subject to any disclaimer, the term of this patent is extended or adjusted under 35 U.S.C. 154(b) by 370 days.

(21) Appl. No.: 18/193,363

(22) Filed: Mar. 30, 2023

(65) Prior Publication Data

US 2024/0325866 A1 Oct. 3, 2024

(51) Int. Cl.
*A63D 15/00* (2006.01)

(52) U.S. Cl.
CPC ..... *A63D 15/006* (2013.01)

(58) Field of Classification Search
CPC ..... A63D 15/006
USPC ..... 473/2
See application file for complete search history.

(56) References Cited

U.S. PATENT DOCUMENTS 2,773,691 A * 12/1956 Redfield ..... A63B 69/0059 473/215
2,809,043 A * 10/1957 De Brouwer ..... A63B 69/0059 473/215
3,419,277 A * 12/1968 Martin ..... A63B 69/0059 473/214
5,181,718 A * 1/1993 Valentine ..... A63D 15/083 473/2
7,722,472 B2 * 5/2010 Cameron ..... A63B 69/0059 473/450
8,550,930 B1 * 10/2013 Medin, III ..... A63B 69/0059 473/215
11,617,939 B2 * 4/2023 Webb ..... A63D 15/105 473/42

* cited by examiner

*Primary Examiner* — Mitra Aryanpour
(74) *Attorney, Agent, or Firm* — Jeffrey C. Watson, Esq.; Grell & Watson Patent Attorneys LLC

(57) ABSTRACT

A billiards training device for grooving a pool stroke includes a strap mechanism. The strap mechanism has a first end and a second end. The strap mechanism includes a loop on the first end and an attachment mechanism on the second end. The loop is configured to be wrapped around an upper arm of a player just above an elbow. The attachment mechanism is configured to be attached to an elevated end of a support structure. Wherein, when the loop is positioned around the upper arm of the player just above the elbow, and the attachment mechanism is attached to the elevated end of the support structure, the billiards training device is configured to aid the player in maintaining the upper arm in a fixed position during the pool stroke.

15 Claims, 9 Drawing Sheets

BILLIARDS TRAINING DEVICE FOR GROOVING A POOL STROKE

FIELD OF THE DISCLOSURE

The present disclosure relates to billiards or pool, and to teaching tools or aids for billiards or pool. More specifically, the present disclosure relates to a billiards training device for grooving a pool stroke.

BACKGROUND

Generally speaking, cue sports like billiards or pool, are a wide variety of games of skill played with a cue, which is used to strike billiard balls and thereby cause them to move around a cloth-covered table bounded by elastic bumpers known as cushions. There are three major subdivisions of games within cue sports: carom billiards, played on tables without pockets, typically ten feet in length, including straight rail, balkline, one-cushion carom, three-cushion billiards, artistic billiards, and four-ball; pool, played on six-pocket tables of seven, eight, nine, or ten-foot length, including among others eight-ball (the world's most widely played cue sport), nine-ball (the dominant professional game), ten-ball, straight pool (the formerly dominant pro game), one-pocket, and bank pool; and snooker, English billiards, and Russian pyramid, played on a large, six-pocket table (dimensions just under 12 ft by 6 ft), all of which are classified separately from pool based on distinct development histories, player culture, rules, and terminology.

Billiards games are mostly played with a stick known as a cue or cue stick. A cue stick is usually either a one-piece tapered stick or a two-piece stick divided in the middle by a joint of metal or phenolic resin. High-quality cues are generally two pieces and are made of a hardwood, generally maple for billiards and ash for snooker. The butt end of the cue stick is of larger circumference and is intended to be gripped by a player's hand. The shaft of the cue stick is of smaller circumference, usually tapering to an 0.4 to 0.55 inches (10 to 14 mm) terminus called a ferrule (usually made of fiberglass or brass in better cues), where a rounded leather tip is affixed, flush with the ferrule, to make final contact with balls. The tip, in conjunction with chalk, can be used to impart spin to the cue ball when it is not hit in its center.

The foundation of playing billiards or pool comes from the stroke. A stroke is the movement made by your cueing arm as it moves the cue stick to contact the cue ball. To get better at pool you need a smooth stroke that moves the cue straight on every shot. Even though it sounds simple to hit a ball in a straight line, it takes practice to shoot straight consistently, especially under pressure situations like a tournament. There are two elements to a consistent stroke: accuracy and follow through. Accuracy is the aspect most beginners start improving first, which is developing a straight, precise cue action. The instant billiards training device may be designed and configured to improving accuracy by helping the player groove their pool stroke.

The instant disclosure recognizes that accuracy of a pool stroke can be improved by making the stroke movement a single hinge or pendulum movement of the forearm about the elbow. In order for the pool stroke to be a single hinge or pendulum movement of the forearm about the elbow, the upper arm must remain still with no movement about the elbow. As such, there is clearly a need to provide a teaching device or training aid configured to help or aid the player in in making the stroke to be a single hinge or pendulum movement of the forearm about the elbow by providing a means to maintain the upper arm still with no movement about the elbow during the pool stroke.

The instant disclosure may be designed to address at least certain aspects of the problems or needs discussed above by providing a billiards training device for grooving a pool stroke.

SUMMARY

The present disclosure may solve the aforementioned limitations of the currently available billiard training devices or aids, by providing a billiards training device for grooving a pool stroke. The billiards training device for grooving a pool stroke may generally include a strap mechanism. The strap mechanism may have a first end and a second end. The strap mechanism may include a loop on the first end and an attachment mechanism on the second end. The loop on the first end of the strap mechanism may be configured to be wrapped around an upper arm of a player just above an elbow. The attachment mechanism on the second end of the strap mechanism may be configured to be attached to an elevated end of a support structure. Wherein, when the loop on the first end of the strap mechanism is positioned around the upper arm of the player just above the elbow, and the attachment mechanism on the second end of the strap mechanism is attached to the elevated end of the support structure, the billiards training device may be configured to aid the player in maintaining the upper arm in a fixed position during the pool stroke.

One feature of the disclosed billiards training device for grooving a pool stroke may be that the loop on the first end of the strap mechanism may be adjustable. In select embodiments, the loop on the first end of the strap mechanism may be adjustable in a holding distance from the attachment mechanism on the second end. In select embodiments, the loop on the first end of the strap mechanism may be adjustable in a size of the loop. In select possibly preferred embodiments, the loop on the first end of the strap mechanism may be adjustable in a holding distance from the attachment mechanism on the second end and may be adjustable in a size of the loop.

In select embodiments of the disclosed billiards training device for grooving a pool stroke, the elevated end of the support structure may be a tip of a support cue stick. Wherein the attachment mechanism on the second end of the strap mechanism may be configured to attach to the tip of the support cue stick. In these embodiments, the attachment mechanism on the second end of the strap mechanism may be a pocket formed on the second end of the strap mechanism. In select embodiments, the pocket on the second end of the strap mechanism may be formed by folding the second end of the strap mechanism over onto itself a set pocket distance and scaling the sides of the strap mechanism the set pocket distance. Wherein, the pocket on the second end of the strap mechanism may be configured to attach to the tip of the support cue stick.

In select embodiments of the disclosed billiards training device for grooving a pool stroke a buckle may be included. The buckle may be positioned on the strap mechanism between the loop on the first end and the attachment mechanism on the second end. The buckle may be configured for adjusting the loop a holding distance from the attachment mechanism and/or for adjusting a size of the loop. In select embodiments of the billiards training device for grooving a pool stroke, the buckle may include teeth on an inner member configured for gripping the strap mechanism. In select embodiments of the billiards training device for grooving a pool stroke, the buckle may be a glide buckle.

In select embodiments of the disclosed billiards training device for grooving a pool stroke, the strap mechanism may be a single strap. The single strap may include the pocket formed on the second end of the single strap. The pocket on the second end may be formed by folding the second end of the single strap over onto itself a set pocket distance and sealing the sides of the single strap the set pocket distance. The single strap with the pocket formed on the second end may then be folded onto itself to create two layers of the single strap with the loop on the first end and the pocket on the second end. The two layers of the single strap may be positioned through the glide buckle. Whereby, the glide buckle may be configured for adjusting the loop the holding distance from the attachment mechanism and/or for adjusting the size of the loop. In select embodiments of the disclosed billiards training device for grooving a pool stroke, the single strap may be a seat belt strap. In select embodiments, the seat belt strap may have a thickness that may be a double thickness.

In another aspect, the instant disclosure embraces the billiards training device for grooving a pool stroke in any embodiment and/or combination of embodiments shown and/or described herein.

In another aspect, the instant disclosure embraces a method for grooving a pool stroke. The method for grooving a pool stroke may generally include providing a billiards training device configured to aid the player in maintaining the upper arm in a fixed position during the pool stroke. The billiards training device for grooving a pool stroke provided in the disclosed method may be provided in any embodiment and/or combination of embodiments shown and/or described herein.

In select embodiments of the disclosed method for grooving a pool stroke, the billiards training device may include a strap mechanism. The strap mechanism may include a first end and a second end. The strap mechanism may have a loop on the first end and an attachment mechanism on the second end. The loop on the first end of the strap mechanism may be configured to be wrapped around an upper arm of a player just above an elbow. The attachment mechanism on the second end of the strap mechanism may be configured to be attached to an elevated end of a support structure. Wherein, the method for grooving a pool stroke may include: attaching the attachment mechanism on the second end of the strap mechanism to the elevated end of the support structure; positioning the loop on the first end of the strap mechanism around the upper arm of the player just above the elbow; and maintaining the upper arm in a fixed position during the pool stroke via the billiards training device.

In select embodiments of the disclosed method for grooving a pool stroke, wherein the elevated end of the support structure is a tip of a support cue stick, wherein the attachment mechanism on the second end of the strap mechanism is configured to attach to the tip of the support cue stick, the method for grooving a pool stroke may include: attaching the attachment mechanism on the tip of the support cue stick.

In select embodiments of the disclosed method for grooving a pool stroke, the method may further include the steps of: getting two pool cues, a support cue stick for the support structure, and a stroking cue stick for use by a player for the pool stroke; inserting the tip of the support cue stick into a pocket on the second end of the strap mechanism of the billiards training device; standing the support cue stick next to a shoulder of a stroke arm of the player with the pocket facing away from the player; sliding the stroke arm into the loop of the billiards training device, with a hand of the stroke arm going through the loop from a front toward a back; positioning the loop all the way to an upper arm or bicep muscle of the stroke arm of the player; bringing the stroke arm between the support cue stick and a body of the player; holding the stroking cue stick and getting down into a stance and a shooting position, bridging on a table surface; taking practice swings or pool strokes with the stroking cue stick, where if the support cue stick interferes, tilting the support cue stick out of the way; swinging the stroking cue stick while pulling the upper arm down on the loop, where if the stroking cue stick can touch a rail, adjusting the billiard training device by reducing a holding distance of the loop from the pocket, and if the stroking cue stick is too elevated, adjust the billiard training device by increasing the holding distance of the loop from the pocket.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-12, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Figure 1:
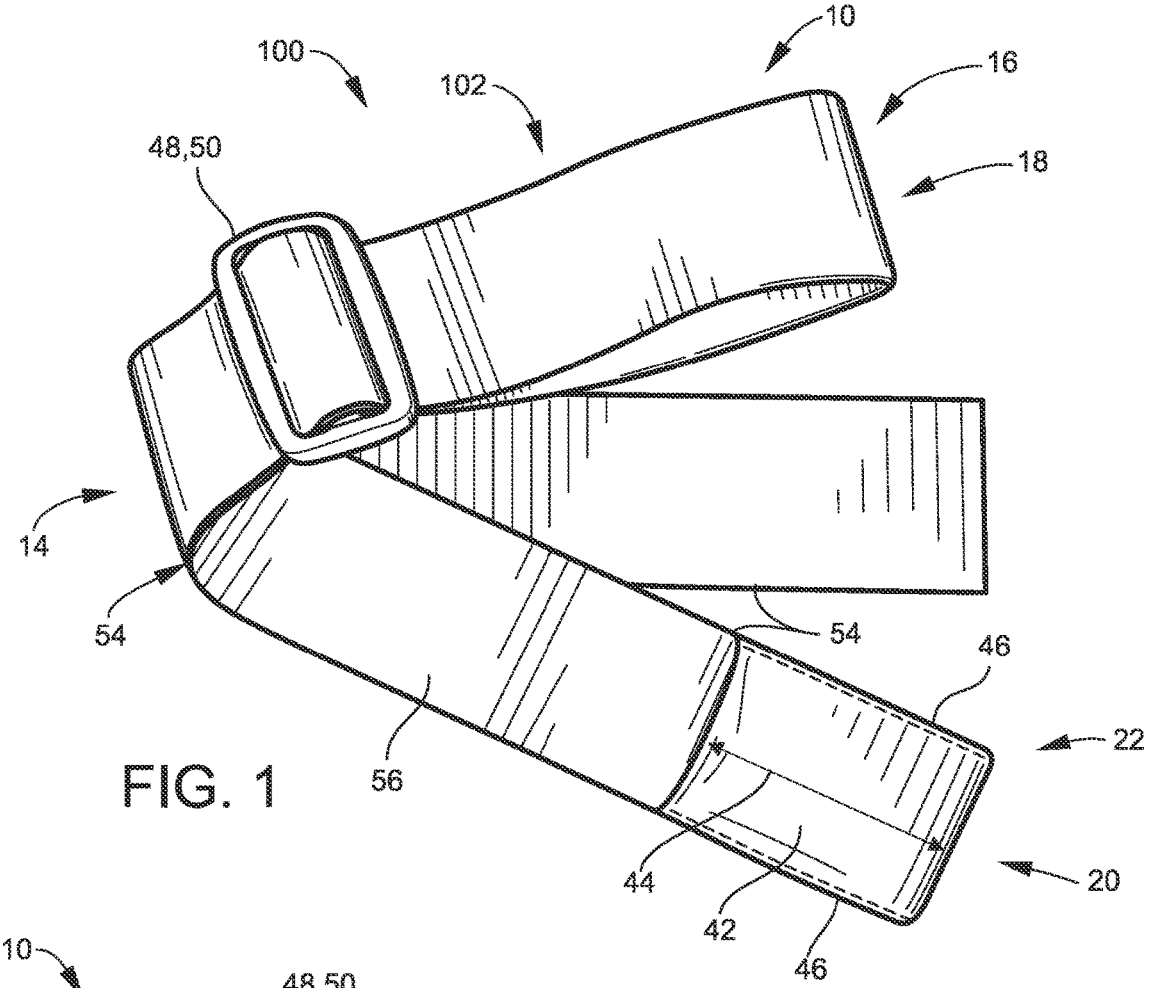
FIG. 1 is a perspective view of the billiards training device for grooving a pool stroke according to select embodiments of the instant disclosure.
Figure 2:
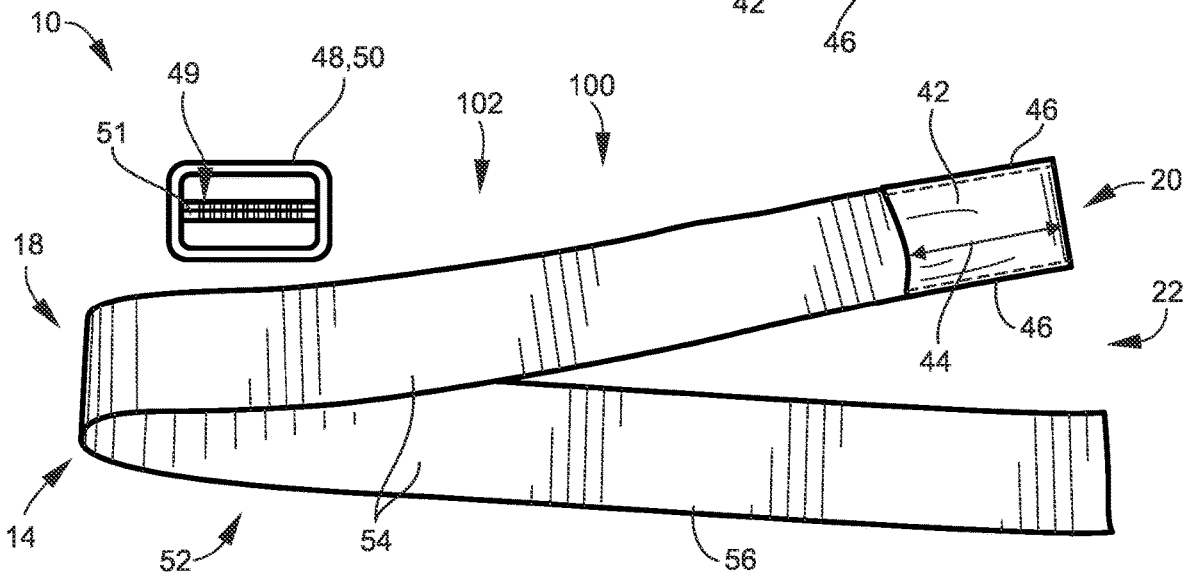
FIG. 2 is a perspective partially disassembled view of the billiards training device for grooving a pool stroke according to select embodiments of the instant disclosure.
Figure 3:
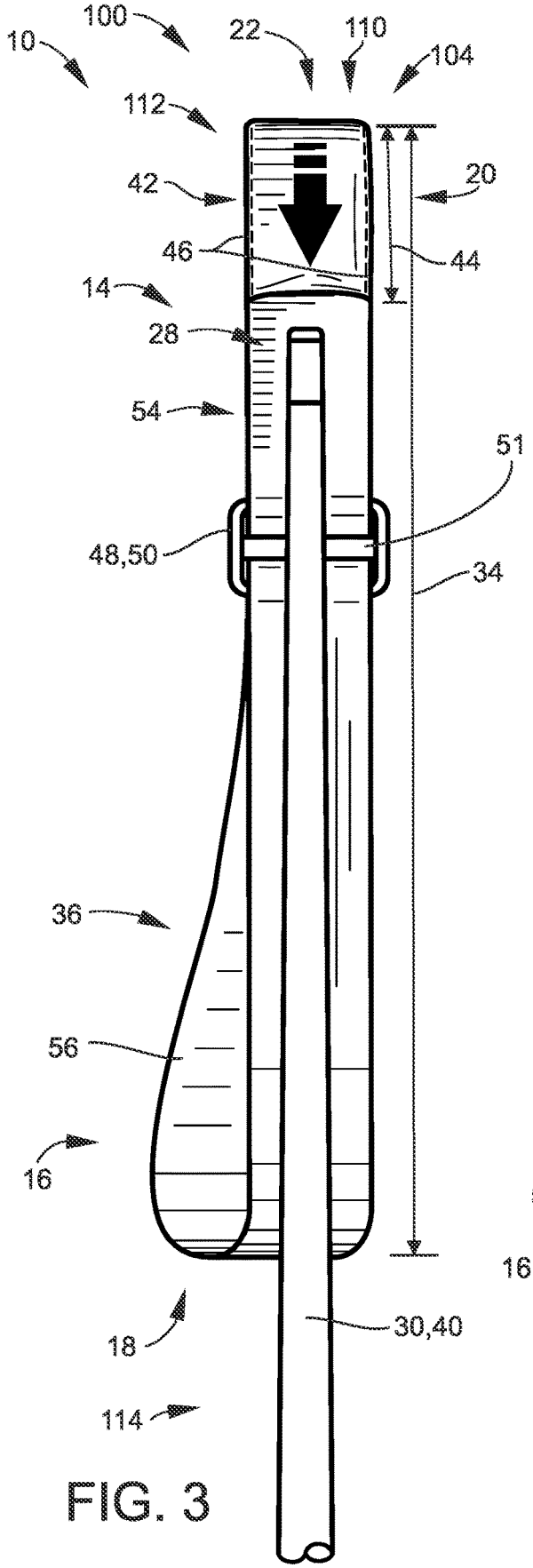
FIG. 3 is an environmental front view of the billiards training device for grooving a pool stroke according to select embodiments of the instant disclosure showing the tip of the support cue stick in position for inserting into the pocket.
Figure 4:
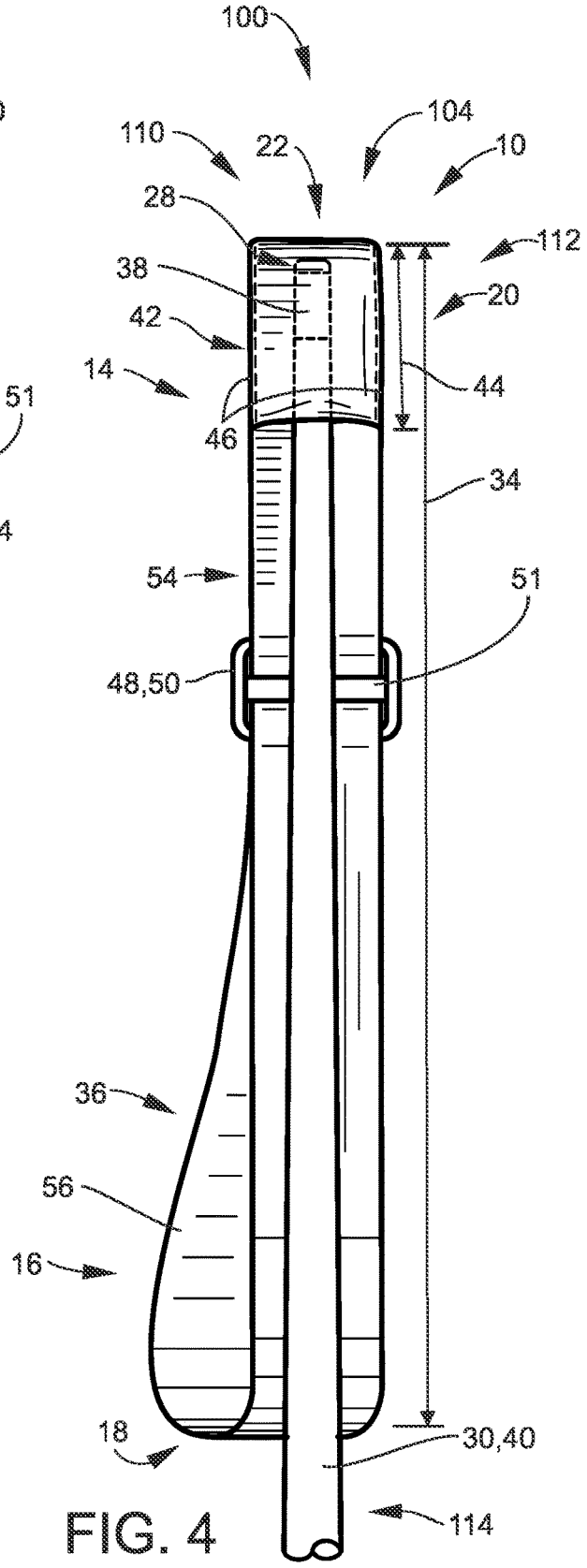
FIG. 4 is an environmental front view of the billiards training device for grooving a pool stroke of FIG. 3 showing the tip of the support cue stick positioned inside of the pocket.
Figure 10:
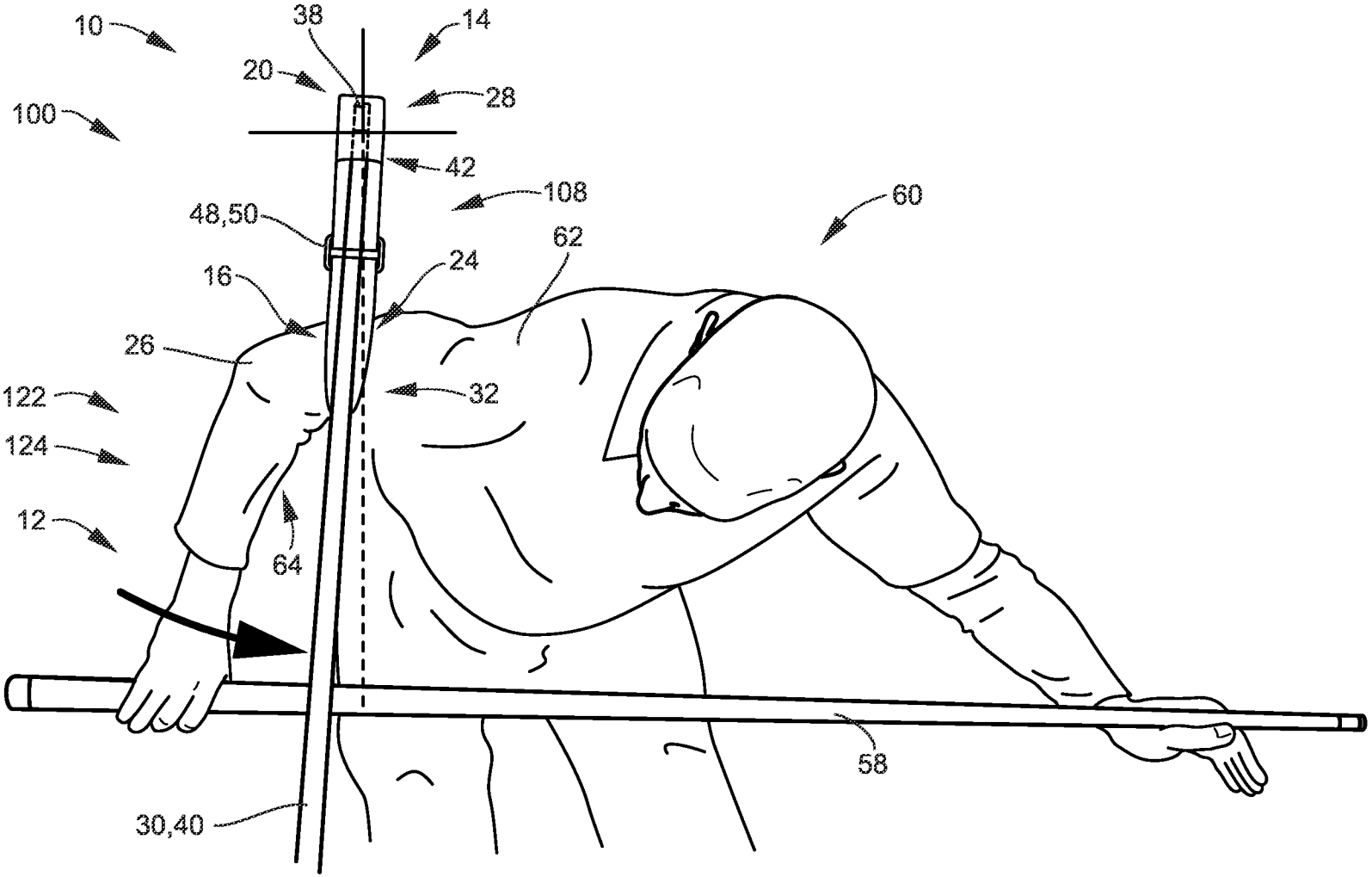
FIG. 10 is an environmental perspective view of the billiards training device for grooving a pool stroke of FIG. 3 showing the player down into a stance and a shooting position where they can bridge on a table surface.
Figure 11:
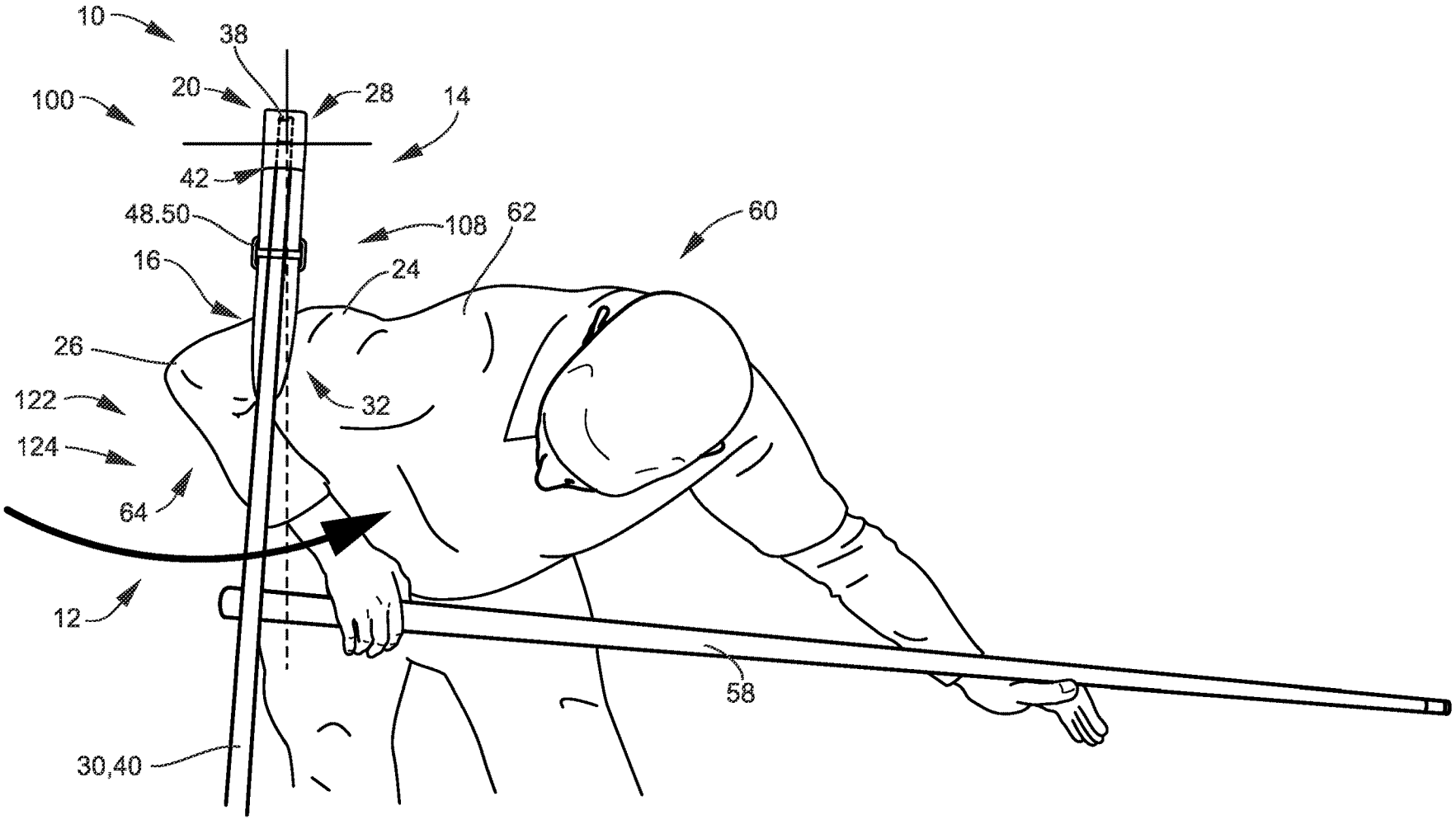
FIG. 11 is an environmental perspective view of the billiards training device for grooving a pool stroke of FIG. 3 showing the player swinging the stroking cue stick while pulling the upper arm down on the loop.

Referring to FIGS. 1-2, the present disclosure may solve the aforementioned limitations of the currently available pool or billiards training devices or aids by providing the disclosed billiards training device 10 for grooving pool stroke 12 (see FIGS. 10-11). Billiards training device 10 for grooving pool stroke 12 may generally include strap mechanism 14. Strap mechanism 14 may have first end 18 and second end 22. Strap mechanism 14 may include loop 16 on first end 18 and attachment mechanism 20 on second end 22. Loop 16 on first end 18 of strap mechanism 14 may be configured to be wrapped around upper arm 24 of player 60 just above elbow 26 (see FIGS. 7-11). Attachment mechanism 20 on second end 22 of strap mechanism 14 may be configured to be attached to elevated end 28 of support structure 30. Wherein, when loop 16 on first end 18 of strap mechanism 14 is positioned around the upper arm 24 of the player just above the elbow 26, and the attachment mechanism 20 on the second end 22 of the strap mechanism 14 is attached to the elevated end 28 of the support structure 30, the billiards training device 10 may be configured to aid player 60 in maintaining upper arm 24 in fixed position 32 during the pool stroke 12 (see FIGS. 10-11).

Referring now specifically to FIGS. 1-6, one feature of the disclosed billiards training device 10 for grooving pool stroke 12 may be that loop 16 on first end 18 of strap mechanism 14 may be adjustable. Loop 16 may be adjustable by any means. In select embodiments, loop 16 on first end 18 of strap mechanism 14 may be adjustable in holding distance 34 from attachment mechanism 20 on second end 22. In select embodiments, loop 16 on first end 18 of strap mechanism 14 may be adjustable in size 36 of loop 16. In select possibly preferred embodiments, loop 16 on first end 18 of strap mechanism 14 may be adjustable in holding distance 34 from attachment mechanism 20 on second end 22 and may be adjustable in size 36 of the loop 16. Buckle 48 may be included on strap mechanism 14 for providing the adjustability in holding distance 34 from attachment mechanism 20 on second end 22 and the adjustability in size 36 of loop 16.

As best shown in FIGS. 3-11, in select embodiments of the disclosed billiards training device 10 for grooving pool stroke 12, elevated end 28 of the support structure 30 may be tip 38 of support cue stick 40. However, the disclosure is not so limited, and other support structures 30 may be utilized that are capable of providing elevated end 28 for supporting billiards training device 10. As shown in the Figures, attachment mechanism 20 on second end 22 of strap mechanism 14 may be configured to attach to tip 38 of support cue stick 40. Attachment mechanism 20 on second end 22 of strap mechanism 14 may be configured to attach to tip 38 of support cue stick 40 by any means or mechanisms. In select embodiments, as shown in the Figures, attachment mechanism 20 on second end 22 of strap mechanism 14 may be pocket 42 formed on second end 22 of strap mechanism 14. In select embodiments, pocket 42 on second end 22 of strap mechanism 14 may be formed by folding second end 22 of strap mechanism 14 over onto itself set pocket distance 44 (see FIGS. 1-7) and sealing sides 46 of strap mechanism 14 the set pocket distance 44. Wherein, pocket 42 on second end 22 of strap mechanism 14 may be configured to attach to tip 38 of support cue stick 40.

In select embodiments of the disclosed billiards training device 10 for grooving pool stroke 12, buckle 48 may be included (see FIGS. 1-11). Buckle 48 may be positioned on strap mechanism 14 between loop 16 on first end 18 and attachment mechanism 20 on second end 22.

Buckle 48 may be configured for adjusting loop 16 holding distance 34 from attachment mechanism 20 and/or for adjusting size 36 of loop 16. In select embodiments of billiards training device 10 for grooving pool stroke 12, buckle 48 may include teeth 49 on inner member 51. Teeth 49 on inner member 51 may be configured for gripping strap mechanism 14. Providing teeth 49 with buckle 48 may provide a better grip of strap mechanism 14 and keep it secure during use of billiards training device 10. In select embodiments of billiards training device 10 for grooving a pool stroke 12, buckle 48 may be a glide buckle 50. Glide buckle 50 may be a tri-glide type glide buckle or the like. In use, glide buckle 50 may be adjusted up and down along strap mechanism 14 for adjusting the size of loop 16. In addition, one or the two layers 54 of strap mechanism 14 may be adjusted up or down on strap for varying holding distance 34 between pocket 42 and second end 22 of strap mechanism 14 (similar to a backpack strap).

Figure 5:
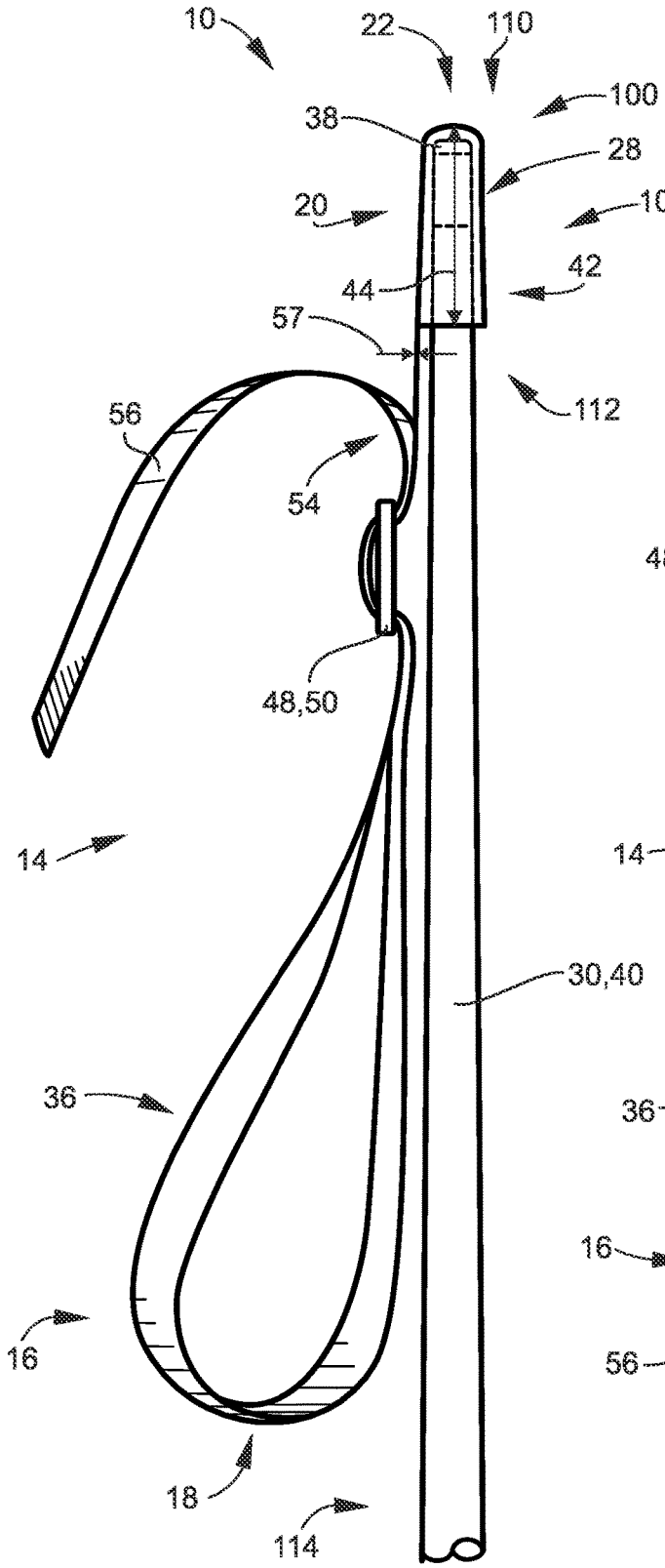
FIG. 5 is an environmental side view of the billiards training device for grooving a pool stroke of FIG. 3 showing the tip of the support cue stick positioned inside of the pocket.
Figure 6:
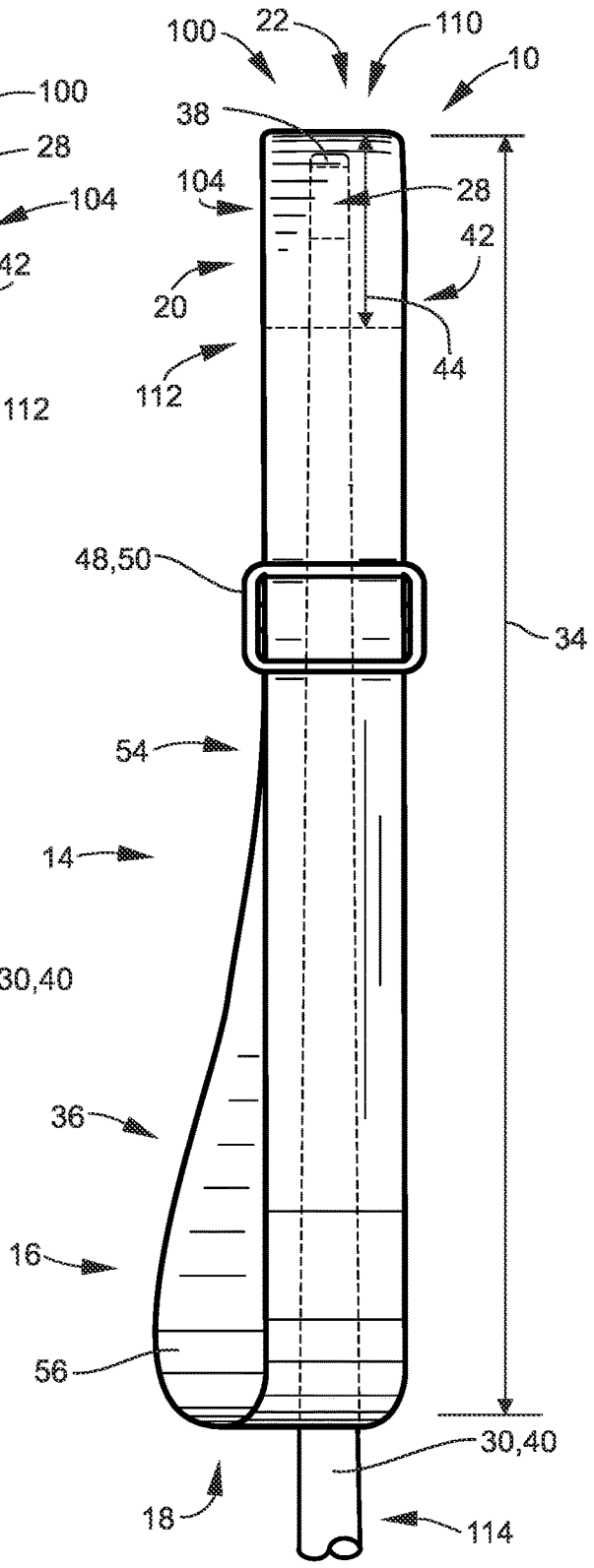
FIG. 6 is an environmental back view of the billiards training device for grooving a pool stroke of FIG. 3 showing the tip of the support cue stick positioned inside of the pocket.
Figure 7:
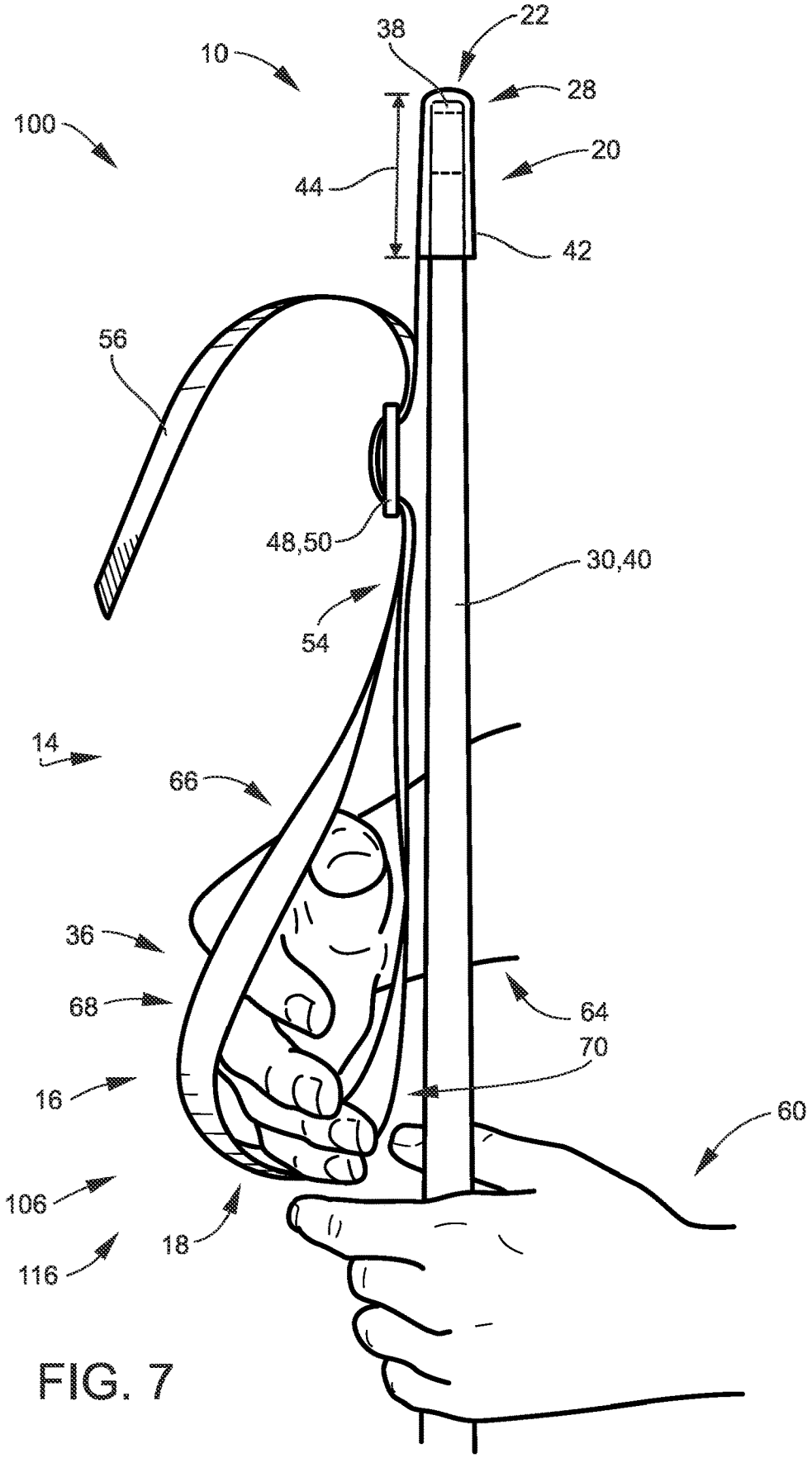
FIG. 7 is an environment side view of the billiards training device for grooving a pool stroke of FIG. 3 showing the hand of the stroke arm being inserted through the look of the strap mechanism from the font to the back.
Figure 8:
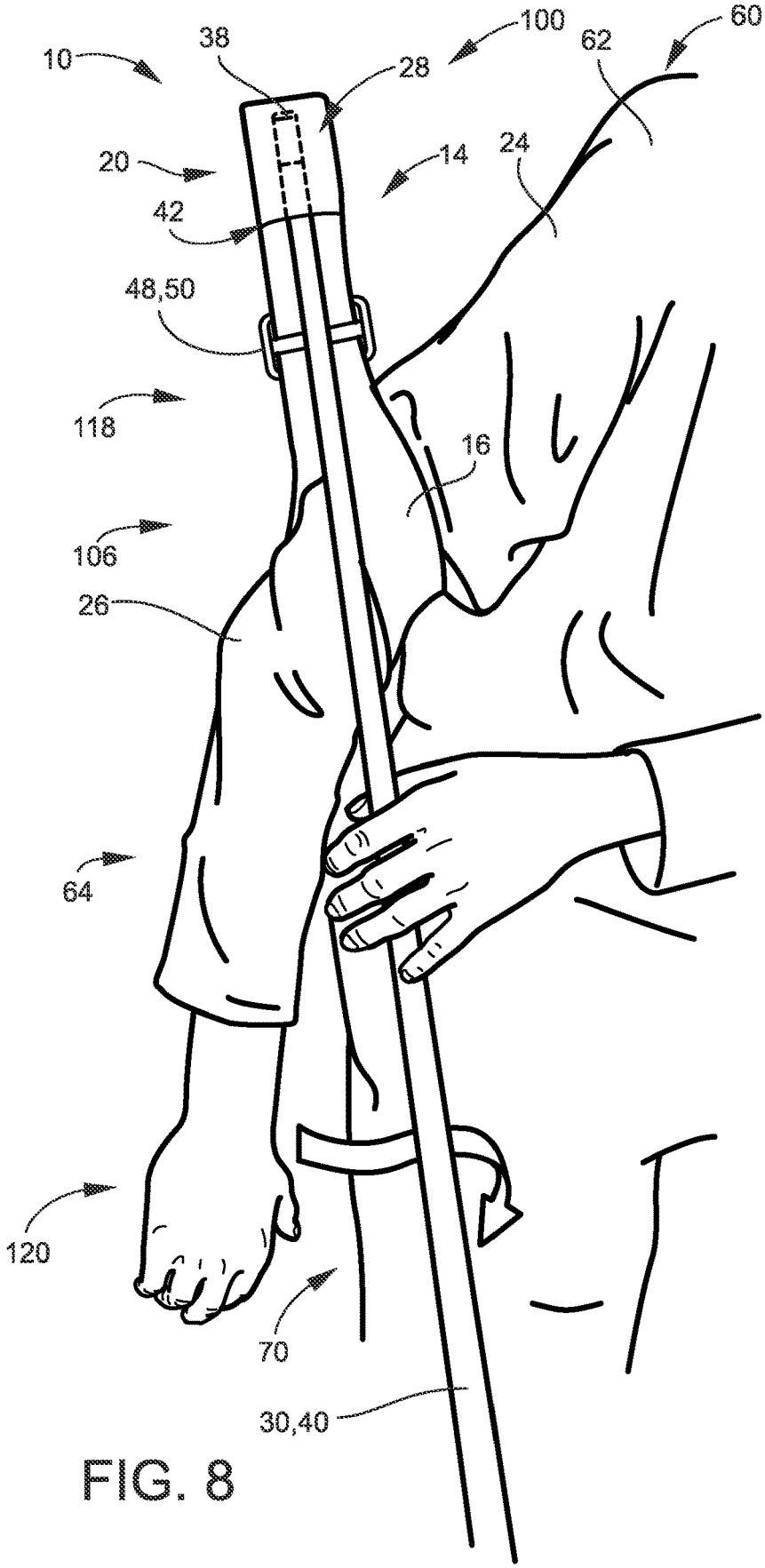
FIG. 8 is an environmental perspective view of the billiards training device for grooving a pool stroke of FIG. 3 showing the step of positioning the loop all the way to the upper arm or bice muscle of the stroke arm and the motion or direction to bring the stroke arm between the support cue stick and the body of the player.
Figure 9:
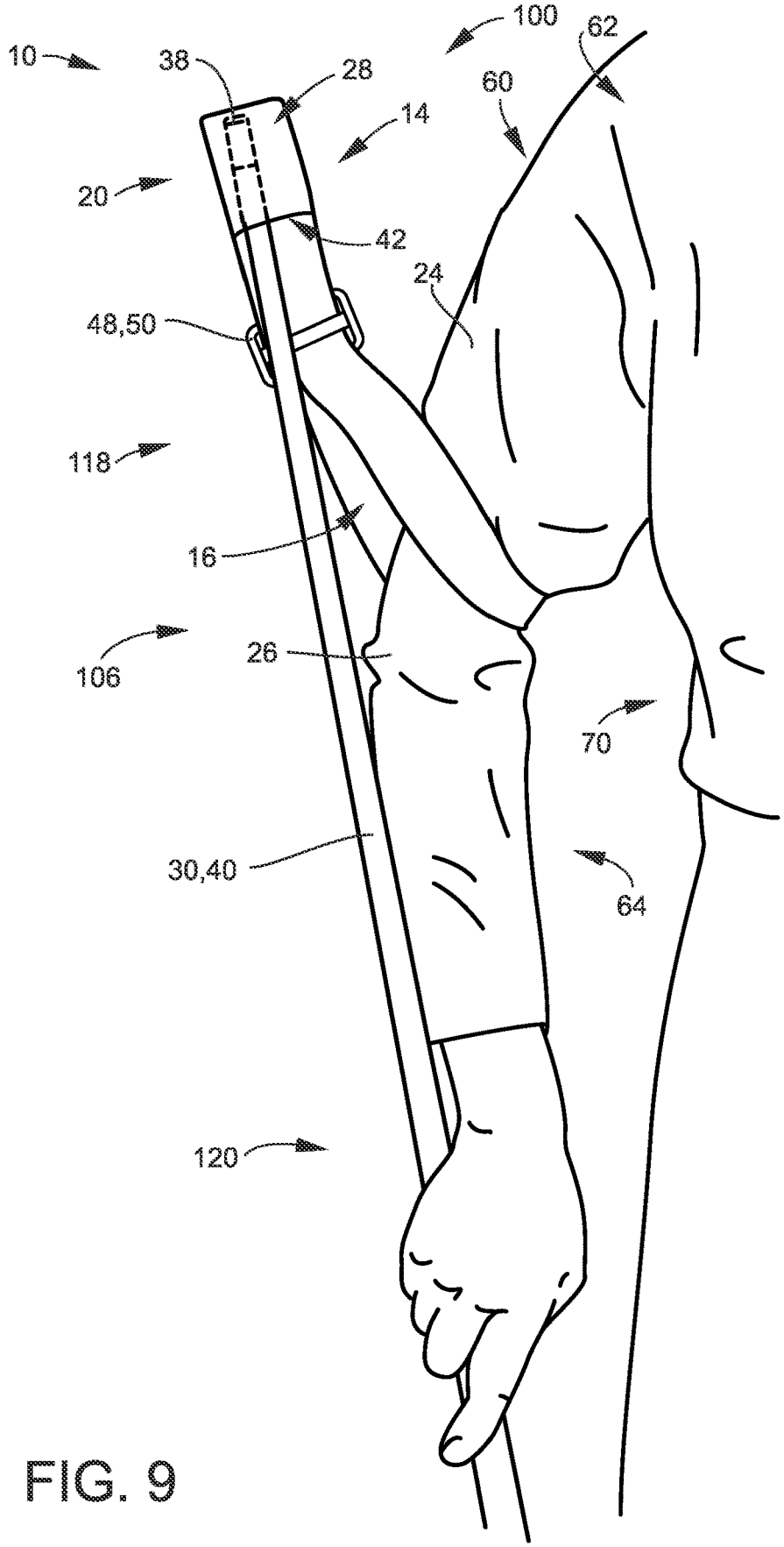
FIG. 9 is an environmental perspective view of the billiards training device for grooving a pool stroke of FIG. 3 showing the player holding the stroking cue stick in order to get down into a stance and a shooting position.

As best shown in FIG. 2, in select embodiments of the disclosed billiards training device 10 for grooving a pool stroke 12, strap mechanism 14 may be single strap 52. Single strap 52 may include pocket 42 formed on second end 22 of single strap 52. Pocket 42 on second end 22 may be formed by folding second end 22 of single strap 52 over onto itself set pocket distance 44 and sealing the sides 46 of single strap 52 the set pocket distance 44. Single strap 52 with pocket 42 formed on second end 22 may then be folded onto itself to create two layers 54 of single strap 52 with loop 16 on first end 18 and pocket 42 on second end 22 (see FIGS. 3-7). The two layers 54 of single strap 52 may be positioned through glide buckle 50. Whereby, glide buckle 50 may be configured for adjusting loop 16 the holding distance 34 from attachment mechanism 20 and/or for adjusting size 36 of the loop 16. In select embodiments of the disclosed billiards training device 10 for grooving a pool stroke 12, single strap 52 may be seat belt strap 56, or the like. Seat belt strap 56 may have any thickness, including a standard seat belt thickness. In select embodiments, as best shown in FIG. 5 seat belt strap 56 may have a thickness that may be double thickness 57, or double the thickness of a standard seat belt thickness.

In another aspect, the instant disclosure embraces the billiards training device 10 for grooving a pool stroke 12 in any embodiment and/or combination of embodiments shown and/or described herein.

Figure 12:
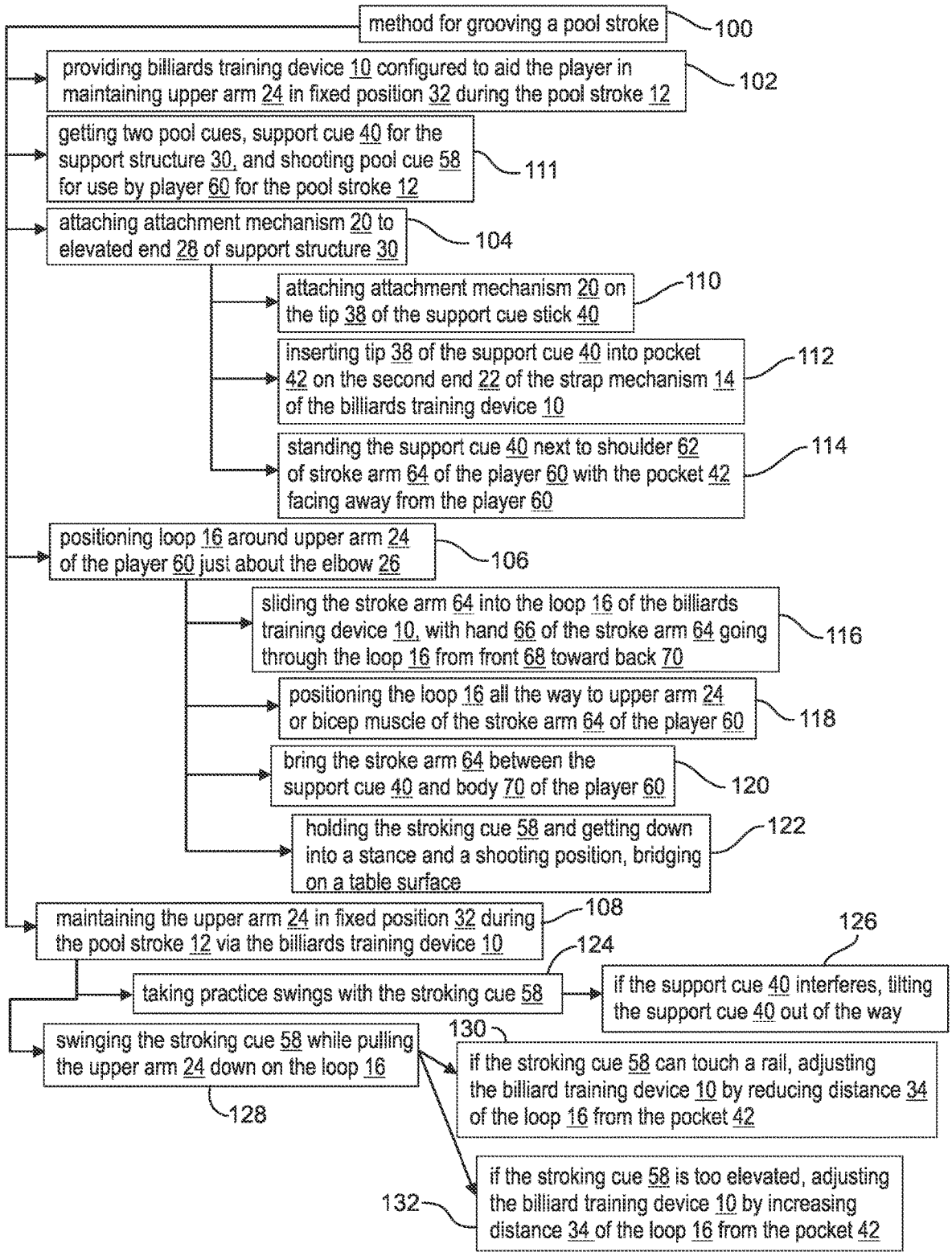
FIG. 12 is a flow chart of the method for grooving a pool stroke according to select embodiments of the instant disclosure.

Referring now to FIG. 12, in another aspect, the instant disclosure embraces method 100 for grooving a pool stroke 12. Method 100 for grooving a pool stroke 12 may generally include step 102 of providing billiards training device 10 configured to aid the player in maintaining upper arm 24 in fixed position 32 during pool stroke 12 (see FIGS. 1-2). Billiards training device 10 for grooving a pool stroke 12 provided in the disclosed method 100 may be provided in any embodiment and/or combination of embodiments shown and/or described herein.

Still referring to FIG. 12, in select embodiments of method 100 for grooving a pool stroke 12, billiards training device 10 may include strap mechanism 14. Strap mechanism 14 may include first end 18 and second end 22. Strap mechanism 14 may have loop 16 on first end 18 and attachment mechanism 20 on second end 22. Loop 16 on first end 18 of strap mechanism 14 may be configured to be wrapped around upper arm 24 of player 60 just above elbow 26. Attachment mechanism 20 on second end 22 of strap mechanism 14 may be configured to be attached to elevated end 28 of support structure 30. Wherein, method 100 for grooving a pool stroke 12 may include: step 104 of attaching the attachment mechanism 20 on second end 22 of strap mechanism 14 to elevated end 28 of support structure 30 (see FIGS. 3-6); step 106 of positioning loop 16 on first end 18 of strap mechanism 14 around upper arm 24 of player 60 just above elbow 26 (see FIGS. 7-9); and step 108 of maintaining upper arm 24 in fixed position 32 during pool stroke 12 via billiards training device 10 (see FIGS. 10-11).

Still referring to FIG. 12, in select embodiments of the disclosed method 100 for grooving a pool stroke 12, wherein the elevated end 28 of support structure 30 is tip 38 of support cue stick 40 (as shown in FIGS. 3-11), wherein attachment mechanism 20 on second end 22 of strap mechanism 14 is configured to attach to tip 38 of the support cue stick 40, method 100 for grooving a pool stroke 12 may include: step 110 of attaching the attachment mechanism 20 on tip 38 of support cue stick 40 (see FIGS. 3-6).

Still referring to FIG. 12, in select embodiments of the disclosed method 100 for grooving a pool stroke 12, the method 100 may further include the steps of: step 111 of getting two pool cues, support cue stick 40 for the support structure 30, and a stroking cue stick 58 for use by player 60 for the pool stroke 12 (see FIGS. 10-12); step 112 of inserting the tip 38 of the support cue stick 40 into pocket 42 on second end 22 of strap mechanism 14 of billiards training device 10 (see FIGS. 3-6); step 114 of standing support cue stick 40 next to shoulder 62 of stroke arm 64 of player 60 with pocket 42 facing away from player 60 (see FIGS. 3-6); step 116 of sliding stroke arm 64 into loop 16 of billiards training device 10, with hand 66 of stroke arm 64 going through loop 16 from front 68 toward back 70 (see FIG. 7); step 118 of positioning loop 16 all the way to upper arm 24 or bicep muscle of stroke arm 64 of player 60 (see FIG. 8); step 120 of bringing stroke arm 64 between support cue stick 40 and body 72 of player 60 (see FIGS. 8-9); step 122 of holding stroking cue stick 58 and getting down into a stance and a shooting position, bridging on a table surface (see FIGS. 10-11); step 124 of taking practice swings or pool strokes 12 with the stroking cue stick 58, where if the support cue stick 40 interferes, step 126 of tilting support cue stick 40 out of the way; step 128 of swinging the stroking cue stick 58 while pulling the upper arm 24 down on loop 16, where if the stroking cue stick 58 can touch a rail, step 130 of adjusting the billiard training device 10 by reducing holding distance 34 of loop 16 from pocket 42 (like by adjusting strap mechanism 14 in buckle 48), and if the stroking cue stick 58 is too elevated, step 132 of adjusting the billiard training device 10 by increasing holding distance 34 of the loop 16 from the pocket 42 (like by adjusting strap mechanism 14 in buckle 48).

The disclosed billiards training device 10 may be designed and configured to improve accuracy by helping the player groove their pool stroke 12 by aiding the player in making the stroke to be a single hinge or pendulum movement of the forearm about the elbow 26 by providing a means to maintain the upper arm 24 still with little to no movement about the shoulder joint 62 thereby maintaining the upper arm 24 at a fixed position during the pool stroke 12.

The billiards training device 10 for grooving a pool stroke 12 may be a very simple tool to use in developing a billiards stroke that is most accurate and consistent. The issue most billiards players have with their basic stroke is preforming the stroke with one moving part, the forearm about the elbow 26. Most players drop their upper arm 24 and elbow 26 during the pool stroke 12, which means the shoulder joint 62 is now involved. This is detrimental to the accuracy of and alignment of the pool stroke 12. Ideally, you want to eliminate movement of all body parts during the stroke, with the exception of the forearm moving about the elbow joint. The instant disclosure may be designed to address at least certain aspects of the problems or needs discussed above by providing billiards training device 10 for grooving a pool stroke 12. The billiards training device 10 may be used during practice, not during competition. It may be a training aid to teach the brain and body the movement that should be used during competition.

In select possibly preferred embodiments of the disclosed billiards training device 10, the material of strap mechanism 14 may be twice as thick (i.e., double thickness 57) so that it is more secure in the tri-glide buckle 50. In addition, in select possibly preferred embodiments, the tri-glide buckle 50 may have teeth 49 on inner member 51 to better grip strap mechanism 14 and keep it secure during use.

The billiards training device 10 for grooving a pool stroke 12 may be a device that is designed to keep the pool players elbow 26 at a set position during the stroke. The device may include a black strap mechanism 14 with pocket 42 at one end and loop 16 at the other. The pocket 42 may be designed to go over a spare pool cue (i.e., support pool cue stick 40) to keep the strap at an elevated position. The loop end may then be positioned around the arm of the player, whereby, the strap will keep the player's elbow 26 at the elevated position.

Billiards training device 10 may train the stroke arm to fold easily and smoothly at the elbow 26. The simplest pool stroke 12 has only one moving part—the forearm, swinging in the elbow 26 joint. In this stroke system, the elbow 26 remains nicely pinned in place throughout the swing. This causes the tip 38 to always return to strike the exact spot the player was aiming on the cue ball, which is a very good thing. The more commonly seen stroking method, which the instant disclosure is training not to do, is much more complex. This common stroke features the upper arm 24 dropping during the swing (rotating down in the shoulder joint). Frequently, this results in the tip 38 striking higher than intended on the cue ball. As that upper arm 24 & elbow 26 drop down, the tip 38 comes up. This movement is not consistent for the pool stroke, is not simple, and thus, not a good thing. On the other hand, a major advantage of the stroke ingrained by the disclosed billiards training device 10 is that players can become more consistent and more precise much more quickly because they are using fewer muscles, fewer joints, and fewer moving parts.

Training with the disclosed billiards training device 10 may help players quickly learn the muscle action and feel of this type of swing, as it won't allow the player to drop the elbow 26. Stroke without a cue ball, feeling the swinging of the forearm and folding of the elbow 26. Allow the folding. No upper arm 24 movement. Swing the stroke hand forward as far as possible. Practicing swinging the hand all the way to the body can help extend the range & quality of the stroke motion. In use, one can try stroking with eyes closed, feeling the swing groove. The user can swing softly. Then the user can swing harder. The user can test themselves, are they pulling down on the billiards training device 10, trying to drop their elbow 26? The user should stroke with maximum awareness, just a few minutes at a time. The user should check their grip pressure. With tight grips, as the grip tightens, the arm becomes stiffer and harder to fold.

The hit stroke should move forward only. It swings forward until the stroke arm runs out of speed or range of motion. Any pulling back on the stick is poking-slowing down on the way to the cue ball. Folding the elbow 26 and swinging all the way forward, for most players, will result in the cue tip coming to rest on the cloth 4" to 6" past where the cue ball was (yes, this is what we want, and no, it doesn't hurt the cloth). Seeing the tip finish on the cloth is confirmation that the elbow 26 did not drop. The user can allow their swing to hit that finish with the tip on the cloth every shot. The user may find it's very satisfying. Later, without the billiards training device 10, when their pool tip does not finish on the cloth, the user will know their elbow 26 must have dropped. The user should think fold, fold, fold!

In sum, the disclosed billiards training device 10 may help players feel, see, and experience the proper stroking action and find their vertical swing groove.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A billiards training device for grooving a pool stroke comprising:

a strap mechanism having a first end and a second end, the strap mechanism including a loop on the first end and an attachment mechanism on the second end;

the loop on the first end of the strap mechanism is configured to be wrapped around an upper arm of a player just above an elbow;

the attachment mechanism on the second end of the strap mechanism is configured to be attached to an elevated end of a support structure;

wherein the attachment mechanism is a pocket formed on the second end of the strap mechanism; and wherein the pocket on the second end of the strap mechanism is formed by folding the second end of the strap mechanism back over onto the strap mechanism a set pocket distance and sealing the sides of the strap mechanism the set pocket distance.

2. The billiards training device for grooving a pool stroke of claim 1, wherein, when the loop on the first end of the strap mechanism is positioned around the upper arm of the player just above the elbow, and the attachment mechanism on the second end of the strap mechanism is attached to the elevated end of the support structure, the billiards training device is configured to aid the player in maintaining the upper arm in a fixed position during the pool stroke.

3. The billiards training device for grooving a pool stroke of claim 1, wherein the loop on the first end of the strap mechanism is adjustable.

4. The billiards training device for grooving a pool stroke of claim 3, wherein the loop on the first end of the strap mechanism is adjustable in a distance from the attachment mechanism on the second end.

5. The billiards training device for grooving a pool stroke of claim 3, wherein the loop on the first end of the strap mechanism is adjustable in a size of the loop.

6. The billiards training device for grooving a pool stroke of claim 3, wherein the loop on the first end of the strap mechanism is adjustable in a distance from the attachment mechanism on the second end and is adjustable in a size of the loop.

7. The billiards training device for grooving a pool stroke of claim 1, wherein the elevated end of the support structure is a tip of a support cue stick, wherein the attachment mechanism on the second end of the strap mechanism is configured to attach to the tip of the support cue stick.

8. The billiards training device for grooving a pool stroke of claim 1, wherein the pocket on the second end of the strap mechanism is configured to attach to a tip of a support cue stick.

9. The billiards training device for grooving a pool stroke of claim 1 further comprising a buckle positioned on the strap mechanism between the loop on the first end and the attachment mechanism on the second end.

10. The billiards training device for grooving a pool stroke of claim 9, wherein the buckle is configured for adjusting the loop a holding distance from the attachment mechanism and for adjusting a size of the loop.

11. The billiards training device for grooving a pool stroke of claim 10, wherein:

the buckle including teeth on an inner member configured for gripping the strap mechanism;

the buckle is a glide buckle; or combinations thereof.

12. The billiards training device for grooving a pool stroke of claim 11, wherein:

the strap mechanism is a single strap including:

a pocket formed on the second end of the single strap, the pocket on the second end is formed by folding the second end of the single strap back over onto the single strap a set pocket distance and sealing the sides of the single strap the set pocket distance;

the single strap with the pocket formed on the second end is then folded back onto the single strap to create two layers of the single strap with the loop on the first end and the pocket on the second end; and the two layers of the single strap are positioned through the glide buckle, whereby the glide buckle is configured for adjusting the loop the holding distance from the attachment mechanism and for adjusting the size of the loop.

13. The billiards training device for grooving a pool stroke of claim 12, wherein the single strap is a seat belt strap having a double thickness.

14. A billiards training device for grooving a pool stroke comprising:

a strap mechanism having a first end and a second end, the strap mechanism includes a loop on the first end and a pocket on the second end;

the loop on the first end of the strap mechanism is configured to be wrapped around an upper arm of a player just above an elbow;

the pocket on the second end of the strap mechanism is configured to be attached to an elevated end of a support structure, the elevated end of the support structure is a support cue stick, wherein the pocket on the second end of the strap mechanism is configured to attach to a tip of the support cue stick;

a glide buckle positioned on the strap mechanism between the loop on the first end and the pocket on the second end, the glide buckle is configured for adjusting the loop a holding distance from the pocket and for adjusting a size of the loop, the glide buckle including teeth on an inner member configured for gripping the strap mechanism;

the strap mechanism is a single strap including:

the pocket formed on the second end of the single strap, the pocket on the second end is formed by folding the second end of the single strap back over onto the single strap a set pocket distance and sealing sides of the single strap the set pocket distance;

the single strap with the pocket formed on the second end is then folded back onto the single strap to create two layers of the single strap with the loop on the first end of the strap mechanism and the pocket on the second end of the strap mechanism;

the two layers of the single strap are positioned through the glide buckle, whereby the glide buckle is configured for adjusting the loop the holding distance from the pocket and for adjusting the size of the loop; and wherein, when the loop on the first end of the strap mechanism is positioned around the upper arm of the player just above the elbow, and the pocket on the second end of the strap mechanism is attached to the elevated end of the support structure, the billiards training device is configured to aid the player in maintaining the upper arm in a fixed position during the pool stroke.

15. A method for grooving a pool stroke comprising:

providing a billiards training device configured to aid a player in maintaining an upper arm in a fixed position during the pool stroke, wherein the billiards training device including:

a strap mechanism having a first end and a second end, the strap mechanism may include a loop on the first end and an attachment mechanism on the second end;

the loop on the first end of the strap mechanism is configured to be wrapped around the upper arm of the player just above an elbow;

the attachment mechanism on the second end of the strap mechanism is configured to be attached to an elevated end of a support structure;

wherein the elevated end of the support structure is a tip of a support cue stick, wherein the attachment mechanism on the second end of the strap mechanism is configured to attach to the tip of the support cue stick;

attaching the attachment mechanism on the second end of the strap mechanism to the elevated end of the support structure including attaching the attachment mechanism on the tip of the support cue stick;

positioning the loop on the first end of the strap mechanism around the upper arm of the player just above the elbow; and maintaining the upper arm in the fixed position during the pool stroke via the billiards training device;

providing two pool cue sticks, a support cue stick for the support structure, and a stroking cue stick for use by the player for the pool stroke;

inserting the tip of the support cue stick into a pocket on the second end of the strap mechanism of the billiards training device;

supporting the support cue stick next to a shoulder of a stroke arm of the player with the pocket facing away from the player;

sliding the stroke arm into the loop of the billiards training device, with a hand of the stroke arm going through the loop from a front toward a back;

positioning the loop all the way to the upper arm of the stroke arm of the player;

bringing the stroke arm between the support cue stick and a body of the player;

holding the stroking cue stick and getting down into a stance and a shooting position, bridging on a table surface;

taking practice swings with the stroking cue stick;

if the support cue stick interferes, tilting the support cue stick out of the way;

swinging the stroking cue stick while pulling the upper arm down on the loop;

if the stroking cue stick can touch a rail, adjusting the billiard training device by reducing a holding distance of the loop from the pocket; and if the stroking cue stick is too elevated, adjusting the billiard training device by increasing the holding distance of the loop from the pocket.

* * * * *